US007629892B1

(12) United States Patent
DeMott

(10) Patent No.: US 7,629,892 B1
(45) Date of Patent: Dec. 8, 2009

(54) RESTRAINING DEVICE AND METHOD OF USE

(76) Inventor: Charles E. DeMott, 3006 Normand Dr., College Station, TX (US) 77845

( * ) Notice: Subject to any disclaimer, the term of this patent is extended or adjusted under 35 U.S.C. 154(b) by 443 days.

(21) Appl. No.: 11/637,305

(22) Filed: Dec. 12, 2006

(51) Int. Cl.
*G08B 21/00* (2006.01)

(52) U.S. Cl. ..... 340/686.1; 70/16; 70/423; 70/DIG. 49; 70/455

(58) Field of Classification Search ..... 70/16, 70/DIG. 49
See application file for complete search history.

(56) References Cited

U.S. PATENT DOCUMENTS

| | | | | | |
|---|---|---|---|---|---|
| 14,030 | A * | 1/1856 | Oldis | 70/46 |
| 116,972 | A * | 7/1871 | Madoe | 70/50 |
| 577,246 | A * | 2/1897 | Grabowski | 70/43 |
| 971,406 | A * | 9/1910 | Remlinger | 70/425 |
| 3,392,554 | A * | 7/1968 | Williamson | 70/16 |
| 3,616,665 | A * | 11/1971 | Rosenthal | 70/16 |
| 3,732,711 | A * | 5/1973 | Albert | 70/425 |
| 4,099,169 | A * | 7/1978 | Donnelly | 340/304 |
| 4,162,622 | A * | 7/1979 | Daleo | 70/16 |
| 4,203,157 | A * | 5/1980 | Daniels et al. | 708/714 |
| 4,570,470 | A * | 2/1986 | Gray, Sr. | 70/428 |
| 4,773,243 | A * | 9/1988 | Lukich | 70/425 |
| 5,007,257 | A * | 4/1991 | Thompson | 70/16 |
| 5,203,187 | A * | 4/1993 | Kane | 70/455 |
| 5,555,751 | A * | 9/1996 | Strickland et al. | 70/16 |
| 6,349,574 | B1 * | 2/2002 | Lurie | 70/16 |
| 6,978,644 | B1 * | 12/2005 | Taper | 70/16 |
| 2007/0289342 | A1 * | 12/2007 | Brooks et al. | 70/16 |

FOREIGN PATENT DOCUMENTS

JP 2003-301649 * 10/2003

* cited by examiner

*Primary Examiner*—Daniel Wu
*Assistant Examiner*—Brian Wilson
(74) *Attorney, Agent, or Firm*—Ted Masters

(57) ABSTRACT

A restraining device includes an alarm circuit which activates an alarm if a restrained individual tampers with the device. The restraining device includes a hinged cover which when closed covers both the key hole of the restraining device and the power source for the alarm circuit. A first sensor senses when the cover is open, and a second sensor senses when the device's double lock mechanism is engaged.

16 Claims, 6 Drawing Sheets

RESTRAINING DEVICE AND METHOD OF USE

TECHNICAL FIELD

The present invention pertains generally to restraining devices such as handcuffs and leg shackles, and more particularly to a restraining device which has an alarm circuit which activates an alarm when the restraining device is being tampered with activates an alarm when the restraining device is being tampered with.

BACKGROUND OF THE INVENTION

Restraining devices such as handcuffs and leg shackles are well known in the art. Such devices are typically placed around the wrists or ankles of individuals to limit their movement. For example, U.S. Pat. No. 4,287,731 illustrates handcuffs with an improved double lock assembly in which the handcuff with conventional pivotal cheek and jaw assembly has a spring element which double locks the handcuff. Additionally, the handcuff has an improved and simplified pivotal mounting for the locking bolt. The double locking feature is designed to prevent the jaw assembly from either tightening or loosening on the individual's wrist after they have been restrained. However, some restrained individuals will try to pick the handcuff lock, or to conceal a real or improvised handcuff key to facilitate their escape.

BRIEF SUMMARY OF THE INVENTION

The present invention is directed to a restraining device and method which reduces the danger posed to law enforcement officers and the public when restraining and transporting restrained individuals. The present invention provides a greater margin of safety by alerting the law enforcement officer when a restrained individual is tampering with the restraining device in an attempt to escape. To achieve this, the present invention includes an optionally activated alarm system which sounds an alarm if the individual attempts to unlock or manipulate the handcuff lock, and thereby allows the officer to take appropriate and necessary action.

In an embodiment of the invention, the restraining device includes a hinged cover plate, an alarm, a power source such as a battery, and two electrical sensors. When closed, the cover covers and prevents access to both the key opening of the restraining device and the power source of the alarm circuit. The alarm, power source, and the two sensors are electrically connected to form an alarm circuit. A first sensor closes the alarm circuit when the cover is open. A second sensor closes the alarm circuit when the double lock mechanism of the restraining device is engaged. When both the cover is open and the double lock mechanism is engaged, the alarm sounds, thereby indicating that the restrained individual is tampering with the restraining device. By utilizing two sensors the alarm circuit allows the cover plate to remain closed while the restraining device is being carried by the law enforcement officer and while being applied to the wrists of the individual being restrained. Once the restraining device is applied to the wrist of the individual the officer engages the double lock mechanism. Once the double lock mechanism is engaged the alarm will sound if the cover plate of the restraining device is opened.

In an embodiment of the invention, the alarm, the sensors, and the power source are water resistant to accommodate the various environmental conditions faced by law enforcement personnel.

The restraining device of the present invention functions in the following manner. The law enforcement officer places the restraining device on the individual to be restrained in the normal manner in accordance with prevailing departmental training and regulations. The cover will be in the closed position while being carried by the officer and applied to the suspect. The restraining device will then be double locked in accordance with departmental policy. As double locking is required by most departments during the transporting of prisoners, no additional steps or training should be necessary to ensure an officer's consistent and proficient use of the present invention. The simple act of double locking the restraining device activates the alarm system. If any attempt is made to open the cover plate the circuit will close and the alarm will sound alerting the officer to the attempt to manipulate the restraining device lock.

In accordance with a preferred embodiment of the invention, a restraining device includes (a) a cover which is selectively placeable in one of (1) a closed position, and (2) an open position, (b) a first sensor which senses when the cover is in the open position, (c) a double lock mechanism which is selectively placeable in one of (1) an engaged position, and (2) a disengaged position, (d) a second sensor which senses when the double lock mechanism is in the engaged position, and (e) an alarm which provides an audio or visual warning. The first and second sensors, the alarm, and a power source (a battery) are electrically connected to form an alarm circuit which activates the alarm if the cover is in the open position and the double lock mechanism is in the engaged position.

In accordance with an aspect of the invention, a power source receptacle receives a power source such as a battery. When in the closed position, the cover covers the power source receptacle and the power source.

In accordance with another aspect of the invention, the restraining device has a key hole. When in the closed position, the cover covers the key hole Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
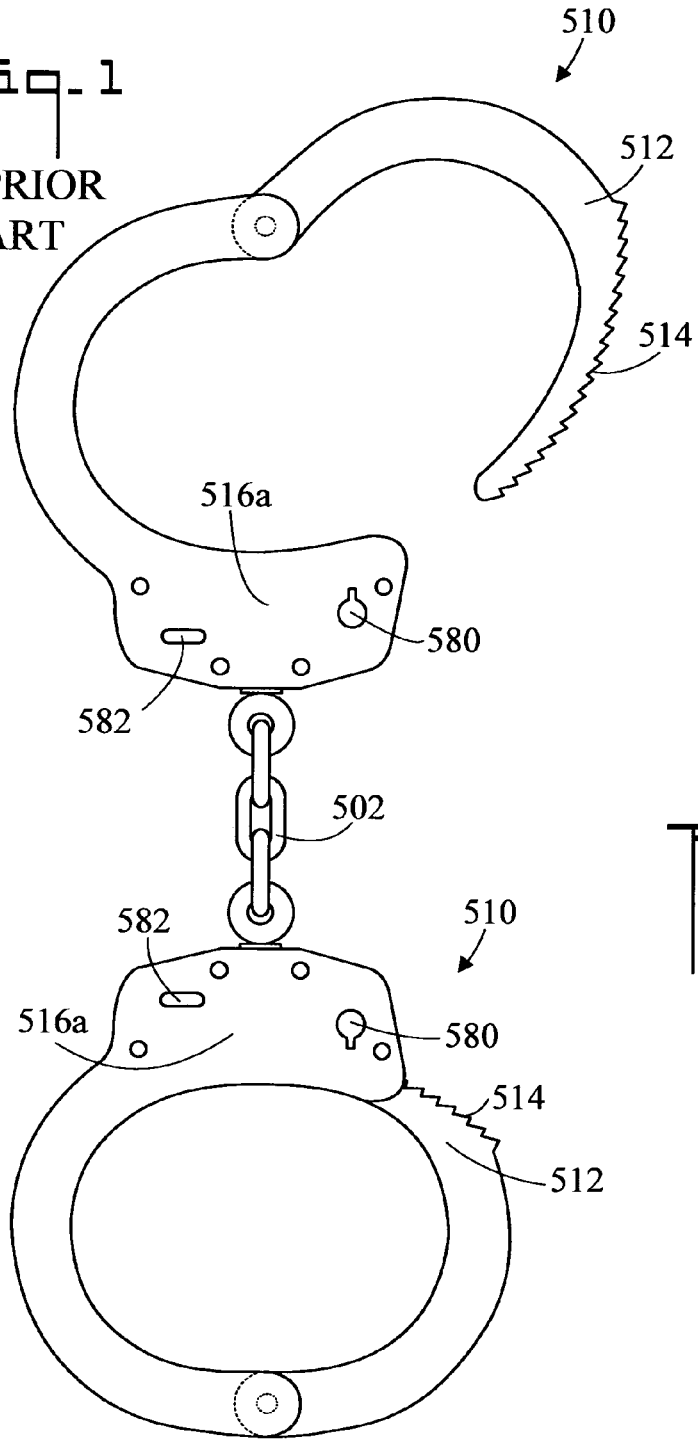
Fig. 1 PRIOR ART
FIG. 1 is a top plan view of prior art handcuffs.
Figure 2:
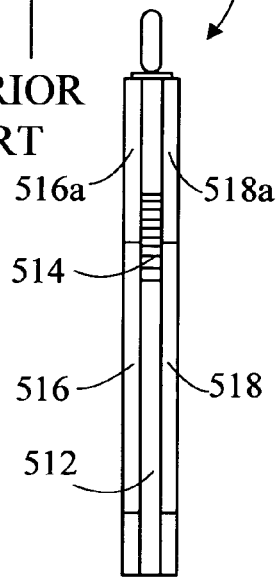
Fig. 2 PRIOR ART
FIG. 2 is a side elevation view of the prior art handcuffs.
Figure 6:
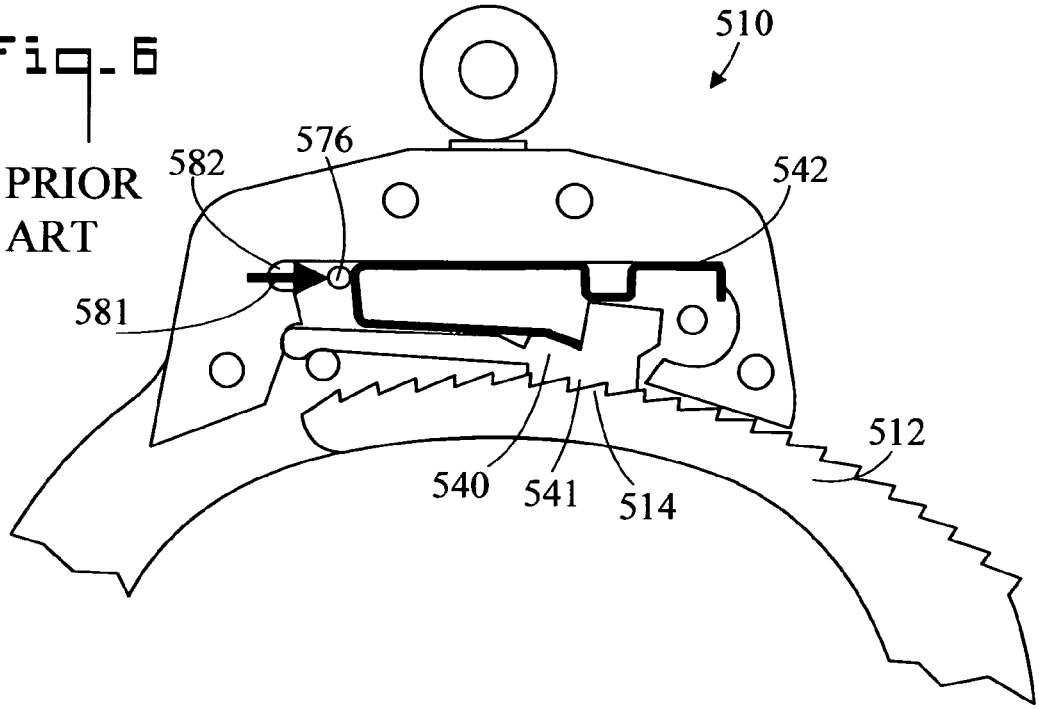
Fig. 6 PRIOR ART
FIG. 6 is an enlarged cutaway side elevation view of the prior art handcuff in a double locked position.
Figure 7:
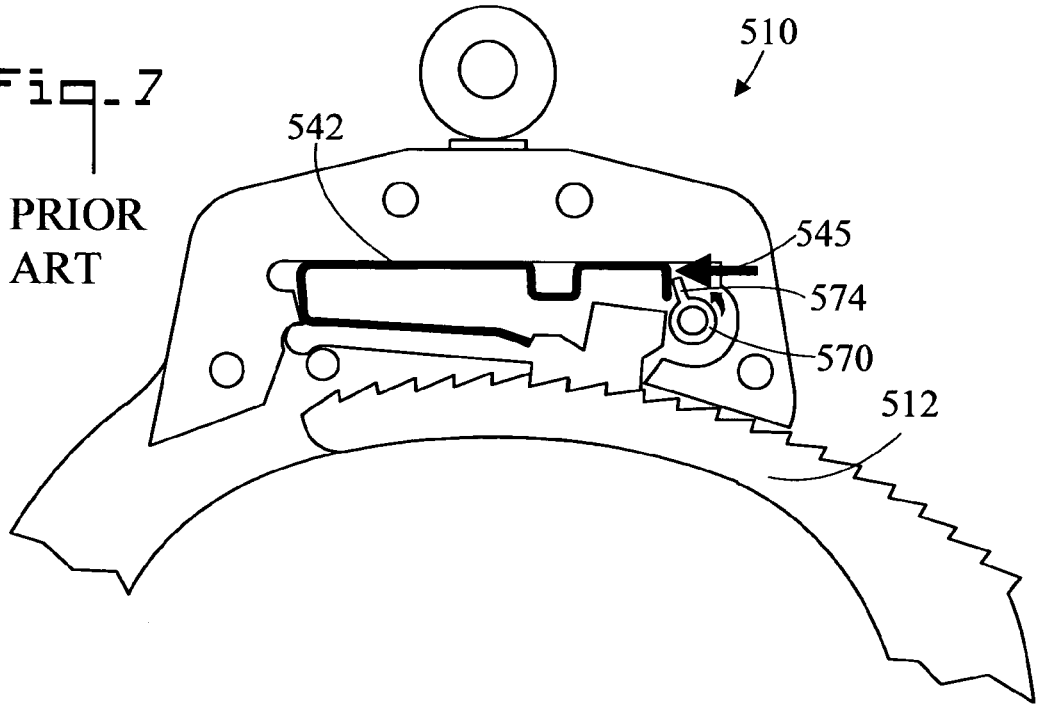
Fig. 7 PRIOR ART
FIG. 7 is an enlarged cutaway side elevation view of the prior art handcuff being taken out of the double locked position.

Referring initially to FIGS. 1-2, there are illustrated top plan and side elevation views respectively of a pair of prior art handcuffs, each handcuff generally designated as 510. Such handcuffs are described in U.S. Pat. No. 4,287,731 the contents of which are included herein by reference in their entirety. The pair of handcuffs 510 are connected by a chain 502. Each handcuff 510 includes an arcuate jaw 512 which is pivotally connected to front 516 and rear 518 cheeks. Jaw 512 has ratchet-like teeth 514 which cooperate with similar teeth on a pawl 540 to lock handcuffs 510 (refer to FIGS. 4 and 5 and the associated discussions). As shown in FIGS. 1, 2, 4, and 11 teeth 514 move between front cheek 516 and rear cheek 518, and engage a pawl 540. Cheeks 516 and 518 terminate in enlarged head portions 516*a* and 518*a* which accept jaw 512. A key hole 580 cooperates with a handcuff key 570 (refer to FIG. 3) to unlock handcuffs 510. A slot 582 also cooperates with key 570 to engage a double lock mechanism which double locks handcuffs 510 (refer to FIG. 6 and the associated discussion). As is shown in FIGS. 6 and 7, the double lock mechanism is disposed between enlarged head portion 516*a* of front cheek 516 and enlarged head portion 518*a* of rear cheek 518. In FIG. 1, the top handcuff 510 is shown in an open unlocked position, and the bottom handcuff 510 is shown in a closed locked position.

Figure 3:
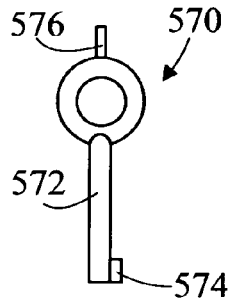
Fig. 3 PRIOR ART
FIG. 3 is a top plan view of a prior art handcuff key.

FIG. 3 is a top plan view of a prior art handcuff key 570. Handcuff key 570 includes a shank 572 and a projection 574 for engaging key hole 580 to unlock handcuffs 510. Handcuff key 570 also includes a pin 576 for entering slot 582 and sliding a bolt spring 542 to engage the double lock mechanism (refer to FIG. 6 and the associated discussion).

Figure 4:
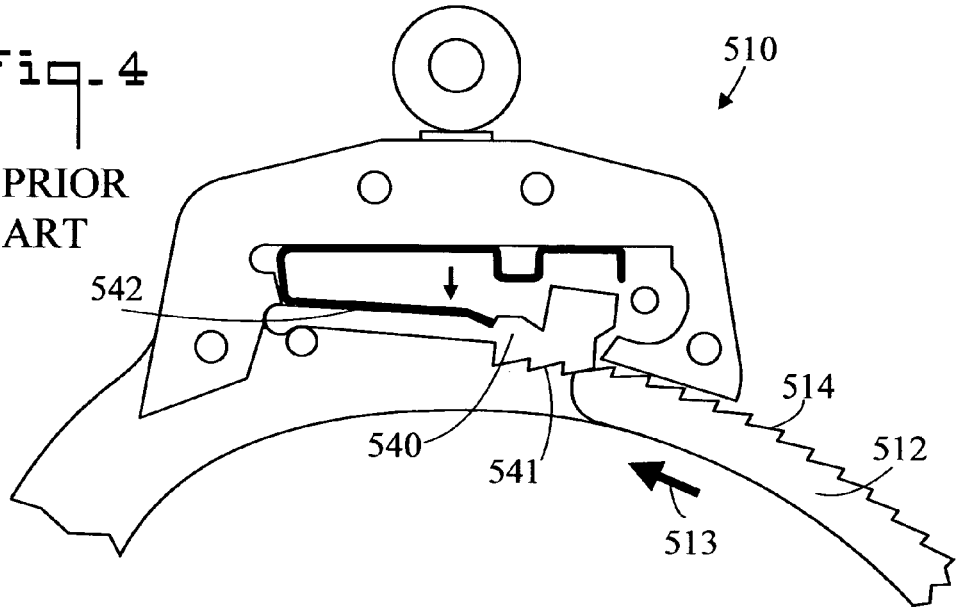
Fig. 4 PRIOR ART
FIG. 4 is an enlarged cutaway side elevation view of prior art handcuff starting to be locked.

FIG. 4 is an enlarged cutaway side elevation view of prior art handcuff 510 starting to be locked. Pawl spring 542 biases pawl 540 toward jaw 512 so that teeth 541 of pawl 540 will engage teeth 514 of jaw 512 in ratchet-like fashion as jaw 512 is moved in direction 513 toward the locked position.

Figure 5:
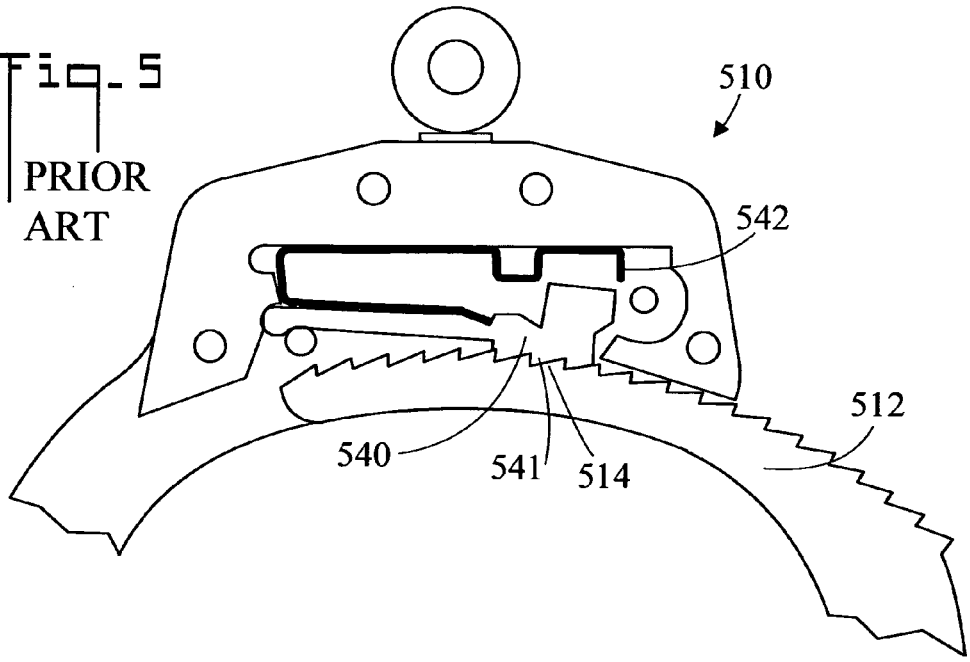
Fig. 5 PRIOR ART
FIG. 5 is an enlarged cutaway side elevation view of the prior art handcuff in a locked state.

FIG. 5 is an enlarged cutaway side elevation view of prior art handcuff 510 in a locked position. Jaw 512 has been moved in direction 513 (refer to FIG. 4) until teeth 541 of pawl 540 engage teeth 514 of jaw 512 thereby holding jaw 512 in the locked position.

FIG. 6 is an enlarged cutaway side elevation view of the prior art handcuff 510 in a double locked position. Also referring to FIGS. 1 and 3, pin 576 of handcuff key 570 has been inserted in slot 582 and moved in direction 581 thereby moving pawl spring 542 to the shown position. In this double locked position a detent in pawl spring 542 prevents pawl 542 from rotating and therefore prevents teeth 541 of pawl 540 from disengaging from teeth 514 of jaw 512. This "double lock mechanism" prevents handcuff 510 from either being tightened or loosened once they have been locked.

FIG. 7 is an enlarged cutaway side elevation view of prior art handcuff 510 being taken out of the double locked position. Also referring to FIGS. 1 and 3, handcuff key 570 has been inserted into key hole 580, and turned in a counterclockwise direction. Projection 574 of urges pawl spring 542 in direction 545 and out of the double locked position.

Figure 8:
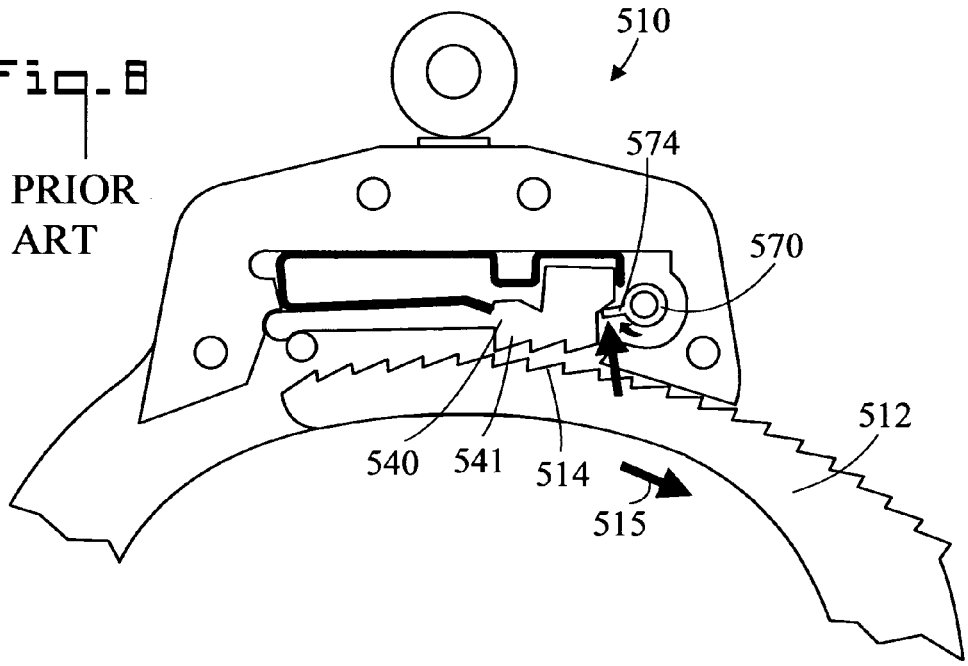
Fig. 8 PRIOR ART
FIG. 8 is an enlarged cutaway side elevation view of the prior art handcuff being unlocked.

FIG. 8 is an enlarged cutaway side elevation view of prior art handcuff 510 being unlocked. Handcuff key 570 is rotated in a clockwise direction wherein projection 574 urges pawl 540 away from jaw 512 so that teeth 541 of pawl 540 disengage from teeth 514 of jaw 512. In this position, jaw 512 may be opened in direction 515 as is shown by the top handcuff 510 of FIG. 1.

Figure 9:
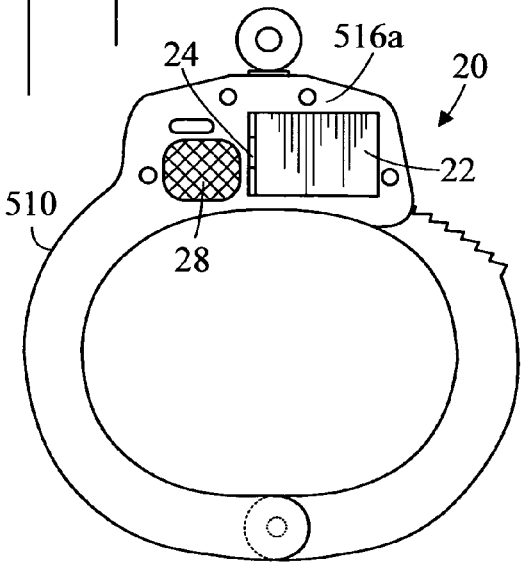
FIG. 9 is a top plan view of a restraining device in accordance with the present invention.

Now referring to FIG. 9, there is illustrated a top plan view of a restraining device (handcuffs, leg shackles, and the like) in accordance with the present invention generally designated as 20. In the shown embodiment, restraining device 20 includes a prior art handcuff 510 as shown and described in FIGS. 1-8, and additionally includes a cover 22 which is selectively positionable to one of (1) a closed position (shown in FIG. 9), and (2) an open position (shown in FIG. 10). In the shown embodiment, cover 22 comprises a plate which is pivotally connected to a hinge 24, and is disposed on the enlarged head portion 516*a* of cheek 516 (refer to FIG. 1 and the associated discussion).

Figure 10:
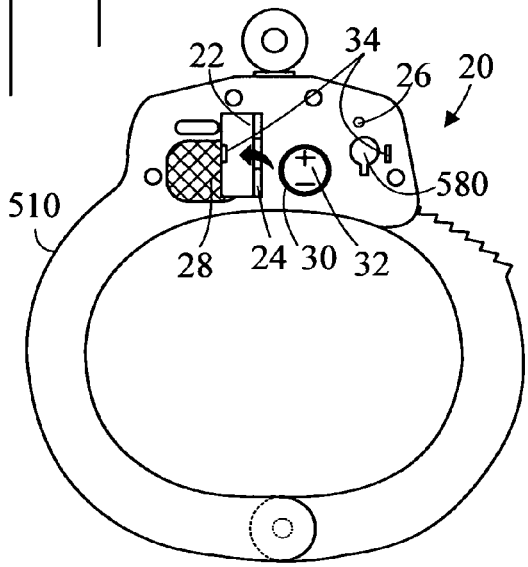
FIG. 10 is top plan view of the restraining device with a cover open.

Now also referring to FIG. 10, restraining device 20 also includes a first sensor 26 which senses when cover 22 is in the open position. In the shown embodiment, first sensor 26 includes a spring loaded pop out electrical switch which makes electrical contact when cover 22 is open (similar to the switch on a refrigerator which turns on the light when the refrigerator door is opened). It may be appreciated however, that other devices such as a magnetic sensor could also be employed to sense that cover 22 is open. A power source receptacle 30 (such as a well) is disposed on head portion 516*a* of cheek 516. Power source receptacle 30 receives a power source (such as a battery 32). When in the closed position of FIG. 9, cover 22 covers power source receptacle 30 and power source 32, thereby denying access to these elements of the invention. When in the closed position of FIG. 9, cover 22 also covers key hole 580, which as shown in FIGS. 1, 9, and 10 is also disposed on enlarged head portion 516*a* of front cheek 516. As such cover 22 must be opened as in FIG. 10 to unlock restraining device 20. Cover 22 also has a latch 34 which retains cover 22 in the closed position of FIG. 9. In another possible embodiment of the invention latch 34 could be mechanically combined with first sensor 26 to form an integrated latch/sensor assembly.

Still referring to FIGS. 9 and 10, restraining device 20 further includes an alarm 28 which is also disposed on head portion 516*a* of cheek 516. Cover 22 does not cover alarm 28. In an embodiment of the invention alarm 28 is an audio alarm such as a buzzer, ringer, siren, or the like. However it may be appreciated that alarm 28 could also be a visual alarm which emits light in addition to or instead of an audio signal.

Figure 11:
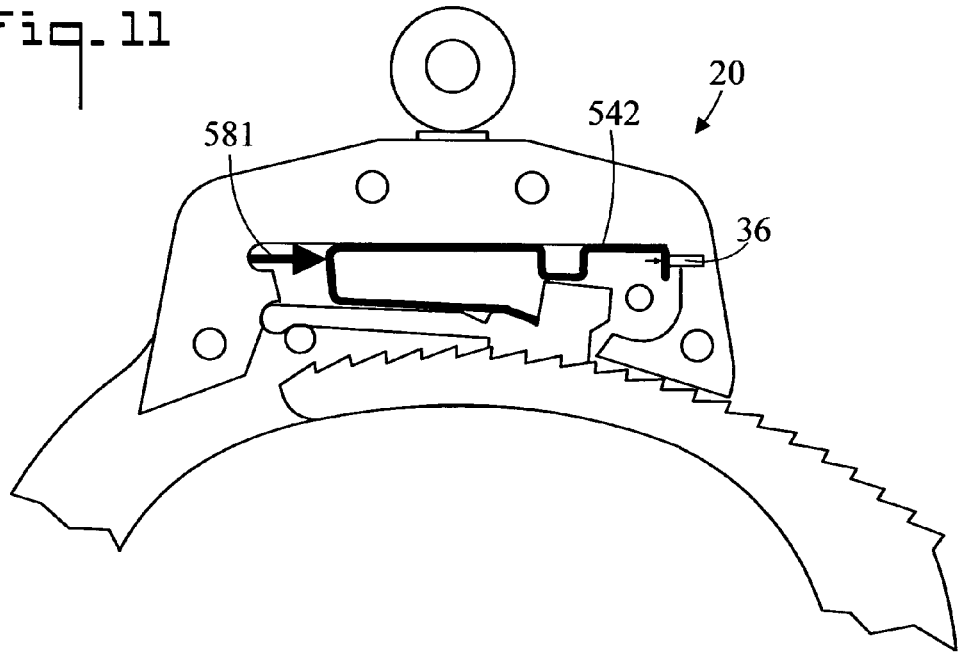
FIG. 11 is an enlarged cutaway side elevation view showing a second sensor.

Now also referring to FIG. 11, restraining device 20 further includes a double lock mechanism (refer to FIG. 6 and the associated discussion) which is selectively positionable to one of (1) an engaged position, and (2) a disengaged position. A second sensor 36 senses when double lock mechanism is in the shown engaged position. In the figure, the double lock mechanism has been placed in the double locked state wherein pawl spring 542 has been moved in direction 581 (refer to FIG. 6 and the associated discussion). In the shown embodiment, second sensor 36 is a pop out electrical switch which makes electrical contact when pawl spring 542 is moved to the right to the double locked position. As with first sensor 26, second sensor 36 could be magnetic.

Figure 12:
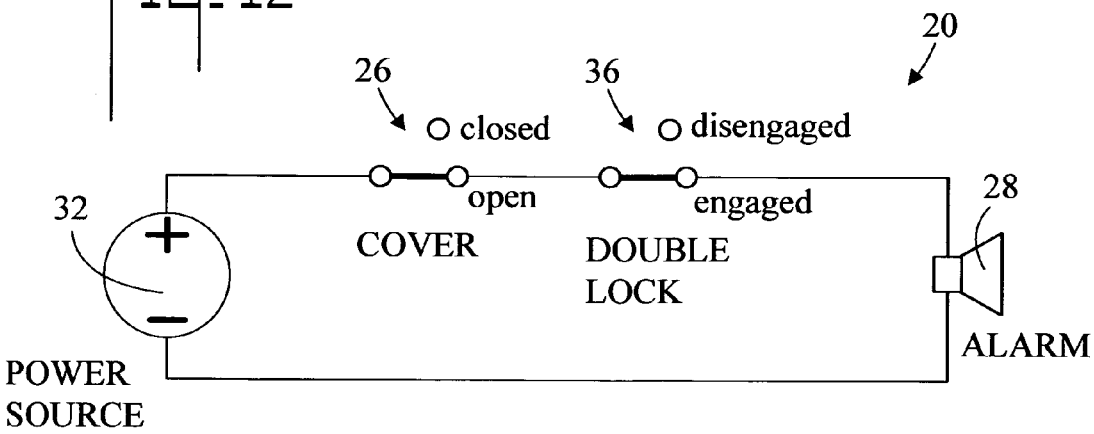
FIG. 12 is a circuit diagram of the present invention.

FIG. 12 is a circuit diagram of the present invention. First sensor 26, second sensor 36, alarm 28, and power source 32 are electrically connected to form an alarm circuit which activates alarm 28 if both (1) cover 22 is in the open position, and (2) the double lock mechanism is engaged. So after double locking, if a restrained individual opens cover 22, alarm 28 will sound and alert a law enforcement officer that restraining device 20 is being tampered with. It is also noted, that the law enforcement officer may optionally chose not to activate the alarm circuit of the present invention. This is simply done by not engaging the double lock mechanism so that the alarm circuit cannot be completed.

Figure 13:
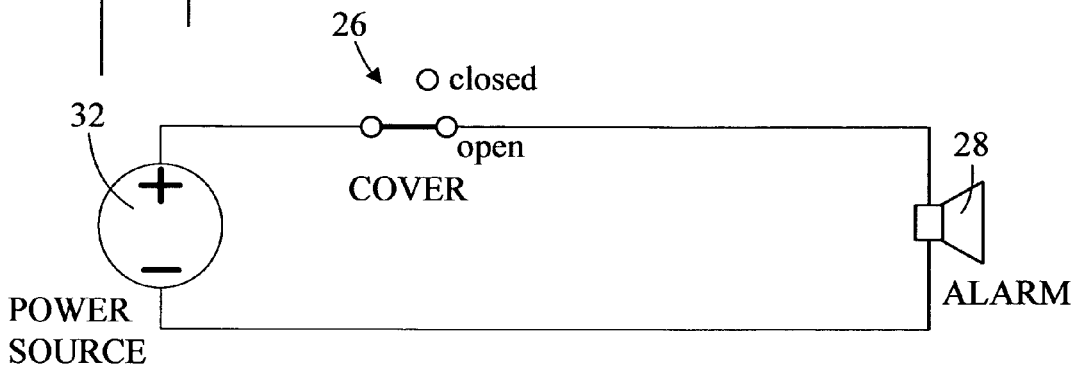
FIG. 13 is a circuit diagram of an alternative configuration of the present invention.

FIG. 13 is a circuit diagram of an alternative configuration of the present invention. In this configuration, first sensor 26, alarm 28, and power source 32 are electrically connected to form a circuit which activates alarm 28 if cover 22 is in the open position.

Figure 14:
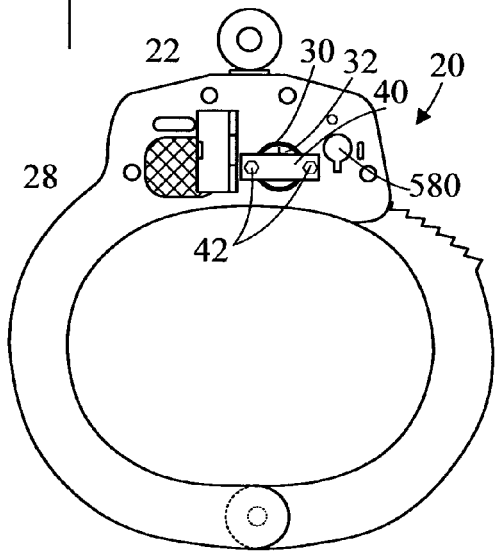
FIG. 14 is a top plan view of a means for mechanically securing the power source in the power source receptacle; and, FIG. 15 is a top plan view of a second embodiment of the present invention.

FIG. 14 is a top plan view of a retainer for mechanically securing power source 32 in power source receptacle 30. In the shown embodiment the retainer is a bar 40 which is locked in place across power source 32 so that bar 40 must be removed in order to remove power source 32. Bar 40 is locked in place with fasteners 42 which require a special tool to loosen (such as an allen wrench). By locking power source 32 in place, a restrained individual is prevented from quickly opening cover 22 and removing power source 32 to deactivate alarm 28.

Figure 15:
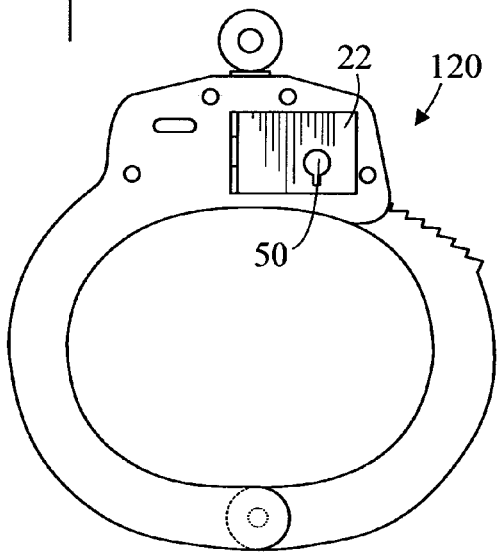

FIG. 15 is a top plan view of a second embodiment of the present invention, generally designated as 120. In this embodiment a lock 50 is provided for locking cover 22 in the closed position. As shown in FIG. 15, lock 50 is disposed on the enlarged head portion of the front cheek. In the shown embodiment, lock 50 is opened by a key, which could be key 570 (refer to FIG. 3). This embodiment of the invention may include or not include the previously described alarm feature of the present invention. In either case, lock 50 prevents a restrained individual from accessing key hole 580 (refer to FIG. 14). If used in conjunction with the alarm feature, lock 50 also prevents a restrained individual from accessing power source 32 (refer to FIG. 14).

In terms of use, a method for restraining and releasing an individual includes:

(a) providing a restraining device 20 including;

a cover 22 which is selectively positionable to one of (1) a closed position, and (2) an open position;

a first sensor 26 which senses when cover 22 is in the open position;

a double lock mechanism which is selectively positionable to one of (1) an engaged position, and (2) a disengaged position;

a second sensor 36 which senses when the double lock mechanism is in the engaged position; and, an alarm 28, wherein first sensor 26, second sensor 36, and alarm 28 are electrically connected to form an alarm circuit which activates alarm 28 if cover 22 is in the open position and double lock mechanism is in the engaged position;

(b) placing and locking restraining device 20 on the individual;

(c) engaging the double lock mechanism;

(d) closing cover 22 to complete the restraining process;

(e) after a period of time, opening cover 22 wherein alarm 28 is activated;

(f) disengaging the double lock mechanism wherein alarm 28 is deactivated; and, (g) unlocking and removing restraining device 20 from the individual.

It is noted that in step (e) alarm 28 is briefly activated. This feature of the present invention serves two useful purposes. The first purpose verifies to the officer that the alarm system is still functioning in the prescribed manner. The second purpose familiarizes the officer with the sound of the alarm, so that it will be easily recognized even under the stressful situations faced by law enforcement officers any time they are forced to restrain an individual.

The preferred embodiments of the invention described herein are exemplary and numerous modifications, variations, and rearrangements can be readily envisioned to achieve an equivalent result, all of which are intended to be embraced within the scope of the appended claims.

I claim:

1. A restraining device, comprising:

a front cheek having an enlarged head portion;

a rear cheek having an enlarged head portion;

an arcuate jaw pivotally connected to said front and rear cheeks, said arcuate jaw having teeth which move between said front cheek and said rear cheek and engage a pawl;

a cover disposed on said enlarged head portion of said front cheek, said cover selectively positionable to one of (1) a closed position, and (2) an open position;

a first sensor which senses when said cover is in said open position;

a double lock mechanism disposed between said enlarged head portion of said front cheek and said enlarged head portion of said rear check, said double lock mechanism selectively positionable to one of (1) an engaged position, and (2) a disengaged position;

a second sensor which senses when said double lock mechanism is in said engaged position; and, an alarm, wherein said first sensor, said second sensor, and said alarm are electrically connected to form an alarm circuit which activates said alarm if said cover is in said open position and said double lock mechanism is in said engaged position.

2. The restraining device according to claim 1, further including:

a power source receptacle disposed on said enlarged head portion of said front cheek; and, when in said closed position, said cover covering said power source receptacle.

3. The restraining device according to claim 1, further including:

a key hole disposed on said enlarged head portion of said front cheek; and, when in said closed position, said cover covering said key hole.

4. The restraining device according to claim 1, further including:

said alarm disposed on said restraining device.

5. The restraining device according to claim 1, further including:

a lock for locking said cover in said closed position, said lock disposed on said enlarged head portion of said front cheek.

6. The restraining device according to claim 1, further including:

a power source receptacle disposed on said enlarged head portion of said front cheek;

when in said closed position, said cover covering said power source receptacle;

a key hole disposed on said enlarged head portion of said front cheek;

when in said closed position, said cover covering said key hole; and said alarm disposed on said restraining device.

7. The restraining device according to claim 1, further including:

said alarm disposed on said restraining device.

8. A method for restraining and releasing an individual, comprising:

(a) providing a restraining device including;

a cover which is selectively positionable to one of (1) a closed position, and (2) an open position;

a first sensor which senses when said cover is in said open position;

a double lock mechanism which is selectively positionable to one of (1) an engaged position, and (2) a disengaged position;

a second sensor which senses when said double lock mechanism is in said engaged position; and, an alarm, wherein said first sensor, said second sensor, and said alarm are electrically connected to form an alarm circuit which activates said alarm if said cover is in said open position and said double lock mechanism is in said engaged position;

(b) placing said restraining device on the individual;

(c) engaging said double lock mechanism;

(d) closing said cover to complete the restraining process;

(e) after a period of time, opening said cover wherein said alarm is activated;

(f) disengaging said double lock mechanism wherein said alarm is deactivated; and, (g) unlocking and removing said restraining device from the individual.

9. A restraining device, comprising:

a front cheek having an enlarged head portion;

a rear cheek having an enlarged head portion;

an arcuate jaw pivotally connected to said front and rear cheeks, said arcuate jaw having teeth which move between said front cheek and said rear cheek and engage a pawl;

a cover disposed on said enlarged head portion of said front cheek, said cover selectively positionable to one of (1) a closed position, and (2) an open position;

a first sensor which senses when said cover is in said open position; and an alarm, wherein said first sensor and said alarm are electrically connected to form an alarm circuit which activates said alarm if said cover is in said open position.

10. The restraining device according to claim 9, further including:

a lock for locking said cover in said closed position, said lock disposed on said enlarged head portion of said front cheek.

11. The restraining device according to claim 9, further including:

a power source receptacle disposed on said enlarged head portion of said front cheek; and, when in said closed position, said cover covering said power source receptacle.

12. The restraining device according to claim 9, further including:

a key hole disposed on said enlarged head portion of said front cheek; and, when in said closed position, said cover covering said key hole.

13. A restraining device of the type having a front cheek having an enlarged head portion, a rear cheek having an enlarged head portion, an arcuate jaw pivotally connected to the front and rear cheeks, the jaw having teeth which move between the front cheek and the rear cheek and engage a pawl, a double lock mechanism disposed between the enlarged head portion of the front cheek and the enlarged head portion of the rear check, the double lock mechanism selectively positionable to one of (1) an engaged position, and (2) a disengaged position, a key hole disposed on the enlarged head portion of the front cheek, the improvement comprising:

a cover disposed on the enlarged head portion of the front cheek, said cover selectively positionable to one of (1) a closed position, and (2) an open position;

a first sensor which senses when said cover is in said open position;

a second sensor which senses when the double lock mechanism is in the engaged position; and, an alarm, wherein said first sensor, said second sensor, and said alarm are electrically connected to form an alarm circuit which activates said alarm if said cover is in said open position and the double lock mechanism is in the engaged position.

14. The improvement of claim 13, further including:

a power source receptacle disposed on the enlarged head portion of the front cheek; and, when in said closed position, said cover covering said power source receptacle.

15. The improvement of claim 13, further including:

when in said closed position, said cover covering the key hole.

16. The improvement of claim 13, further including:

said alarm disposed on the restraining device.

* * * * *